US005497987A

United States Patent [19]

Henn et al.

[11] Patent Number: 5,497,987

[45] Date of Patent: Mar. 12, 1996

[54] SHEET-GUIDING DEVICE

[75] Inventors: Manfred Henn, Heidelberg; Josef Wehle, Schwetzingen, both of Germany

[73] Assignee: Heidelberger Druckmaschinen AG, Heidelberg, Germany

[21] Appl. No.: 501,275

[22] Filed: Jul. 17, 1995

Related U.S. Application Data

[63] Continuation of Ser. No. 214,965, Mar. 16, 1994, abandoned.

[30] Foreign Application Priority Data

Mar. 16, 1993 [DE] Germany ..... 43 08 276.9

[51] Int. Cl.[6] ..... B65H 29/04

[52] U.S. Cl. ..... 271/204; 406/88; 101/232

[58] Field of Search ..... 271/204, 205, 271/206; 406/82, 86, 88; 101/232, 240, 408, 409, 487, 488

[56] References Cited

U.S. PATENT DOCUMENTS

| | | | |
|---|---|---|---|
| 3,167,012 | 1/1965 | Claybourn | 271/204 X |
| 3,633,281 | 1/1972 | Vits | 34/1 |
| 4,479,645 | 10/1984 | Pollich | 271/204 X |
| 4,920,881 | 5/1990 | Tafel | 101/488 |
| 5,102,118 | 4/1992 | Vits | 271/195 |
| 5,263,415 | 11/1993 | Pollich | 271/204 X |

FOREIGN PATENT DOCUMENTS

| | | | |
|---|---|---|---|
| 0094151 | 11/1983 | European Pat. Off. . | |
| 0427015 | 5/1991 | European Pat. Off. . | |
| 0502417 | 9/1992 | European Pat. Off. . | |
| 1907083 | 4/1975 | Germany . | |
| 3713344 | 2/1988 | Germany | 271/204 |
| 3936846 | 4/1991 | Germany . | |
| 296053 | 11/1991 | Germany . | |
| 3-7149 | 1/1991 | Japan . | |
| 1007534 | 10/1965 | United Kingdom . | |
| 1042688 | 9/1966 | United Kingdom . | |
| 1301285 | 12/1972 | United Kingdom . | |

*Primary Examiner*—William E. Terrell
*Assistant Examiner*—Carol L. Druzbick
*Attorney, Agent, or Firm*—Herbert L. Lerner; Laurence A. Greenberg

[57] ABSTRACT

Device for guiding a sheet having a leading edge which follows an imaginary conducting surface along a sheet-transport direction perpendicular to the leading edge, the sheet-guiding device being formed with a sheet-guiding surface spaced from the imaginary conducting surface, and having equipment for generating a plurality of air jets for applying an air flow to the sheet between a surface of the sheet and the sheet-guiding surface, the generating equipment being formed of respective flow channels for the air jets disposed at an angle to and merging with the sheet-guiding surface, includes an integral guide plate having a surface constituting a predominant part of the sheet-guiding surface, the integral guide plate being formed with perforations, the air-jet generating equipment being formed of blast-air nozzles having blast-air nozzle end faces constituting a remaining part of the sheet-guiding surface complementing the predominant part of the sheet-guiding surface to form the entire sheet-guiding surface, the blast-air nozzles fitting into the respective perforations formed in the guide plate so that the blast-air nozzle end faces are flush with the surface of the guide plate, the blast-air nozzles, respectively, having the respective flow channels formed thereon, and being formed with a nozzle bore passing therethrough and communicating with the respective flow channel.

6 Claims, 2 Drawing Sheets

2
2
1
3
1
6
V
4
5
II
III

IV 6
11
10
8
17
15
16
18
14
20
25
26
37
36.3
35
27
19.1 (19.2)
21
36.2
36.1

16'
6
29
31
9
11
32
16'
8

20
33
28
34
25'
19.1 (19.2)
21
10'
14'
30
39
38

6
7
11''
11'
11
8

13
12
9
14
10

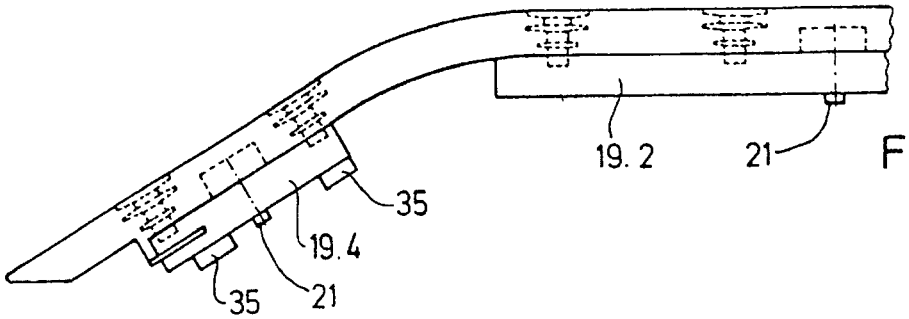
Fig. 6
Fig. 5
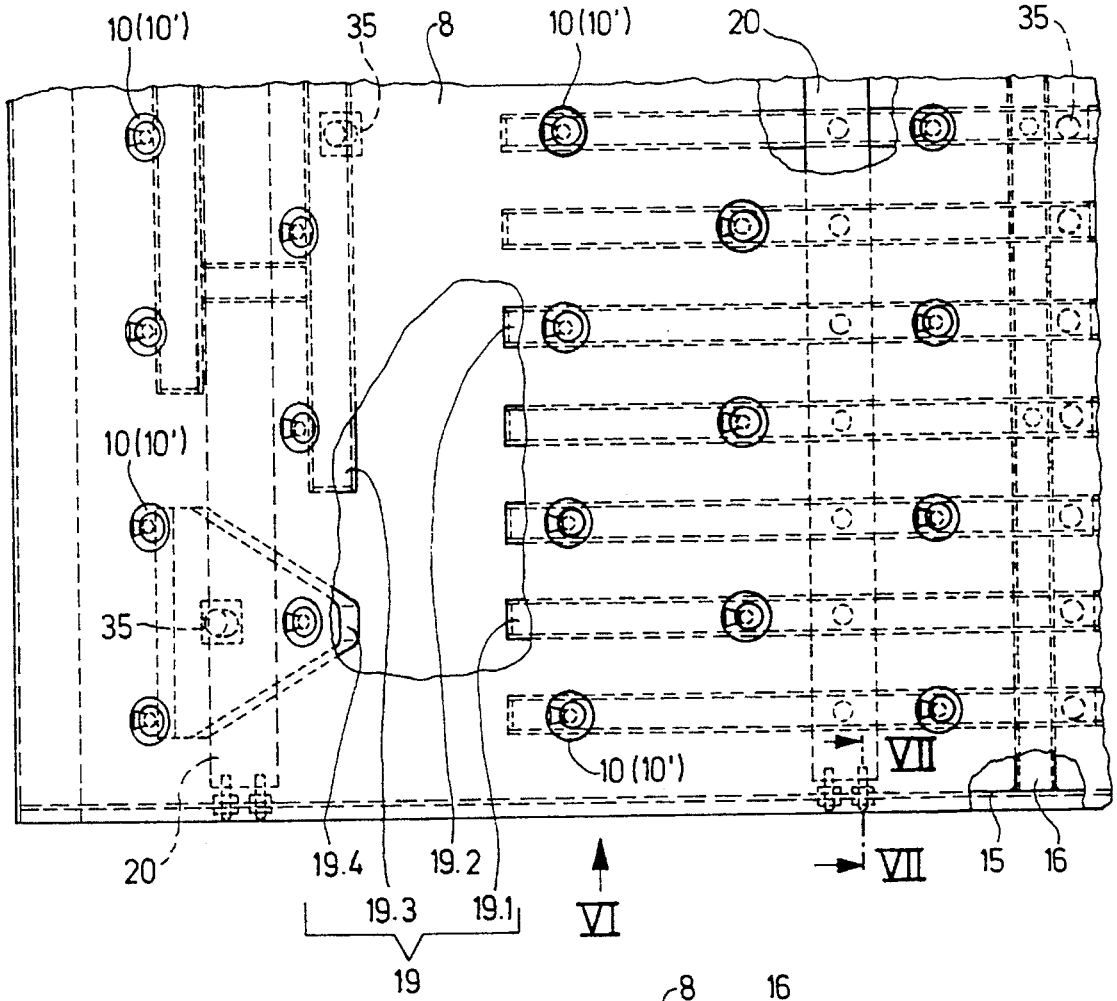
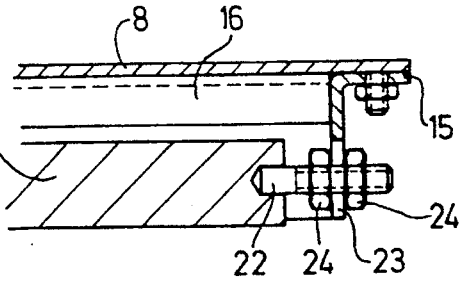
Fig. 7

SHEET-GUIDING DEVICE

This application is a continuation of application Ser. No. 08/214,965, filed Mar. 16, 1994, now abandoned.

The invention relates to a sheet-guiding device and, more particularly, to such a device for guiding a sheet having a leading edge which follows an imaginary conducting surface along a sheet-transport direction perpendicular to the leading edge, the sheet-guiding device being formed with a sheet-guiding surface spaced from the imaginary conducting surface, and having means for generating a plurality of air jets for applying an air flow to the sheet between a surface of the sheet and the sheet-guiding surface, the generating means being formed of respective flow channels for the air jets disposed at an angle to and merging with the sheet-guiding surface.

Such a guiding device has become known heretofore, for example, from the published Japanese Patent Document 3-7149 U which discloses a so-called chain delivery of a sheet-fed rotary printing press, wherein a leading edge of a printed sheet is gripped temporarily in a gripper system articulatedly connected to endless chains of a chain pair revolving in parallel paths, so that the leading edge of the sheet follows an imaginary conducting surface along a sheet-transport direction perpendicular to the leading edge. Provided at a respective distance from locations on the conducting surface is a sheet-guiding surface in the form of a surface of a guide plate. A respective sheet, on the path thereof which is forced thereon by the gripper system, is exposed to an air flow between the sheet and the sheet-guiding surface. This air flow is produced by individual air jets escaping from the sheet-guiding surface. The following measures are taken in the conventional guiding device for the purpose of channeling a respective air jet.

The guide plate is regionally bent angularly within its margins, in the form of rectangular lugs, about a bending edge parallel to the leading edge of the sheet, in such a manner that the lugs are directed away from the conducting path situated at that point above the guide plate and, consequently, the free ends of the lugs lie below the guide plate. A respective lug is associated with a blast-air box, disposed likewise below the guide plate, wherein a section of the guide plate serves as a lid for the blast-air box and an upper side-wall section of the blast-air box is angularly bent towards the lug, terminates above the free end of the lug, forming a gap between the side-wall section and the guide plate, and rests on this free end. The aforementioned gap represents an outlet opening for an air flow which flows from the blast-air box through the gap left in the guide plate by an angularly bent lug. The blast-air box thus forms a flow channel which merges with or terminates in the sheet-guiding surface, and the section of the guide plate serving as a lid for the blast-air box forms a baffle plate which deflects the air jet.

A plurality of such arrangements emitting a respective air stream are distributed over the guide plate. They pursue the objective of guiding without smearing to a delivery pile a sheet held in a gripper system of the chain delivery, the sheet, in particular, also having been printed on the underside thereof. This objective is all the more difficult to achieve, the higher the speed is at which the leading edge of the sheet passes through the conducting path. This is because, at high speeds, even minor deviations of a sheet-guiding surface from the ideal form thereof have a detrimental effect, the ideal form being characterized, in particular, in that the sheet-guiding surface comprises an ideally straight generatrix. It would further be required of an ideal form that imaginary lines along the sheet-guiding surface perpendicular to the generatrix exhibit no waves, much less discontinuities. In the aforedescribed conventional guiding device, however, such requirements with regard to a sheet-guiding surface are, for manufacturing-related reasons, virtually unfulfillable, at least not without quite considerable effort. Due merely to the forming of the lugs from the guide plate by performing shearing and bending operations thereon, unevennesses result which would be very difficult to rectify. The aforedescribed structure of the blast-air boxes indicates that the guide plate is welded to these ends of the walls of the blast-air boxes which face towards the guide plate. Even in the case of bent-away or folded ends of these walls and a spot-welded connection of these ends to the guide plate, further unevennesses are inevitable, especially as the spot welds would have to be placed at relatively small distances from one another due to the required sealing of the blast-air boxes.

Heating devices for more-rapidly drying the printed sheets may possibly also be integrated into chain deliveries of the aforementioned general type. In such a case, there would be additional distortions of the guide plate, particularly on a guiding device of the aforedescribed type.

Heretofore known from German Published Prosecuted Patent Application (DE-AS) 19 07 083 is a guiding device which differs from the aforedescribed device particularly also in that there is no forced guiding for a front edge of a sheet which is to be guided. The construction disclosed therein provides for a sheet-guiding surface in the form of a surface of a wall formed with outlet openings for blast-air jets, the wall being a limiting wall of an otherwise closed blast-air channel which extends along a desired transport path of the sheet. A respective outlet opening for a blast-air jet is so formed that regions of the aforementioned limiting wall are used exclusively for channelling the blast-air jet. The formation of an outlet opening calls for the lowering of a circular arcuate-shaped region of the limiting wall downwardly inclined into the blast-air channel, so that a corresponding circular arcuate-shaped edge of a lug-shaped region of the nondeformed limiting wall is situated above a radially internal edge of the lowered region. The lug-shaped region thus performs the function of a baffle plate and the circular arcuate-shaped region of the limiting wall, rising towards the surface of the limiting wall, represents a flow channel which merges with or terminates in the sheet-guiding surface. With such a construction of the means for channelling the air jets, no deformations of the sheet-guiding surface due to local heating during welding operations are indeed to be feared, but nevertheless there does exist also the problem of the deformation of the sheet-guiding surface in connection with shearing and bending operations as mentioned hereinbefore in connection with the initially mentioned heretofore known guiding device.

Furthermore, although, by an appropriate juxtaposition of the provided blast-air channels transversely to the sheet-conducting path, the blast-air channels are capable of subjecting the sheet to an air flow across the entire width of the sheet, this does not provide a closed sheet-guiding surface, so that this construction, also, provides a sheet-guiding surface which differs considerably from the ideal form thereof. This is because, unless special elaborate measures are taken, the joints between the juxtaposed individual blast-air channels result, firstly, in specific differences in height between adjoining limiting walls provided with the outlet openings and, secondly, in grooves caused by normal cross-sectional shapes of such blast-air channels and extending in the direction of the transport path of the sheet. Both phenomena, however, have a disadvantageous effect upon the formation of such an air flow between the sheet and the sheet-guiding surface, so that the air flow fulfills its intended purpose of conducting the sheet without contact along the sheet-guiding surface and of stabilizing the sheet along the transport path thereof.

It is accordingly an object of the invention to provide, with a minimum possible effort, a sheet-guiding device of the general type mentioned in the introduction hereto, wherein contact between the sheet and a sheet-guiding surface, as a result of disturbances in air flow, is prevented.

With the foregoing and other objects in view, there is provided, in accordance with the invention, a device for guiding a sheet having a leading edge which follows an imaginary conducting surface along a sheet-transport direction perpendicular to the leading edge, the sheet-guiding device being formed with a sheet-guiding surface spaced from the imaginary conducting surface, and having means for generating a plurality of air jets for applying an air flow to the sheet between a surface of the sheet and the sheet-guiding surface, the generating means being formed of respective flow channels for the air jets disposed at an angle to and merging with the sheet-guiding surface, comprising an integral guide plate having a surface constituting a predominant part of the sheet-guiding surface, said integral guide plate being formed with perforations, the air-jet generating means being formed of blast-air nozzles having blast-air nozzle end faces constituting a remaining part of the sheet-guiding surface complementing the predominant part of the sheet-guiding surface to form the entire sheet-guiding surface, the blast-air nozzles fitting into the respective perforations formed in the guide plate so that the blast-air nozzle end faces are flush with the surface of the guide plate, the blast-air nozzles, respectively, having the respective flow channels formed thereon, and being formed with a nozzle bore passing therethrough and communicating with the respective flow channel.

The construction of the sheet-guiding device according to the invention permits the attainment, in particular, of a sheet-guiding surface which virtually does not deviate from the aforedescribed ideal form. An essential contribution thereto is made by a basic concept of the invention which calls for the sheet-guiding surface to be formed of mutually complementary components so that it is possible, both in the manufacture of the components and also in the assembly thereof, to prevent defects of form that might have a negative effect upon the ideal form. Thus, the fact that, according to the invention, the predominant part of the sheet-guiding surface is in the form of the surface of an integral or one-piece guide plate formed with perforations is able, without major effort, to ensure, in particular, that the guide plate is not already formed with manufacturing-related defects as to form or shape, because the perforations can be effected by the use of relatively simple punching tools which, in the vicinity of the perforations, do not cause any deformations having a practical impact upon the flatness of the guide plate in the vicinity. In the implementation of the aforementioned basic idea in accordance with the invention, moreover, the respective flow channel is formed on a blast-air nozzle which can be manufactured independently of the guide plate. This ensures, in particular, the production of the means for channelling the respective air jets using manufacturing processes which afford a process-inherent dimensional accuracy with which defects as to form or shape, with a practical impact on the sheet-guiding surface, can be excluded.

In accordance with another feature of the invention, the parts of the sheet-guiding surface formed by the guide plate and by the blast-air nozzle end faces are highly polished to a like surface quality.

In accordance with a further feature of the invention, the guiding device includes a first assembly comprising the guide plate, and a second assembly comprising a blast air-conducting tube system, the first assembly being connected to the second assembly in a distortion-free manner, the nozzle bores, respectively, of the blast-air nozzles being directly connected to blast air conducted in the conducting tube system, and the blast-air nozzles being fixed only to one of the two assemblies. Such a construction of the guiding device of the type initially described in the introduction hereto also prevents large-area defects of form or shape of the sheet-guiding surface.

In accordance with an added feature of the invention, the guiding device includes a cooling device for cooling the sheet-guiding surface. The advantage associated with this feature becomes particularly apparent when a guiding device according to the invention is employed for a delivery of a sheet-fed rotary printing press, wherein the delivery is equipped with a dryer.

In accordance with an additional feature of the invention, the cooling device comprises a coolant trough having a coolant flowing therethrough, the guide plate forming a lid sealing the coolant trough, the coolant trough comprising a trough floor formed with recesses located opposite the perforations formed in the guide plate, a respective perforation of the guide plate and a respective recess of the trough floor located opposite the respective perforation being sealed by a respective blast-air nozzle against escape of the coolant from the coolant trough.

In accordance with yet another feature of the invention, the blast-air nozzles are aligned in a like manner so that the air jets escaping from the respective flow channels generate an air flow in the same direction as the sheet-transport direction.

In accordance with a concomitant feature of the invention, the blast-air nozzles are distributed over the sheet-guiding surface and are combined into functional groups, and a respective blast-air port is included having a respective functional group of blast-air nozzles associated therewith for supplying blast air to the blast-air nozzles of the respective functional group.

Other features which are considered as characteristic for the invention are set forth in the appended claims.

Although the invention is illustrated and described herein as embodied in a guiding device for a sheet, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 5 is an enlarged fragmentary plan view of FIG. 1 as seen in the direction of the arrow V;

FIG. 6 is a side elevational view of FIG. V as seen in the direction of the arrow VI; and FIG. 7 is an enlarged fragmentary cross-sectional view of FIG. VI taken along the line VII in the direction of the arrows.

Figure 1:
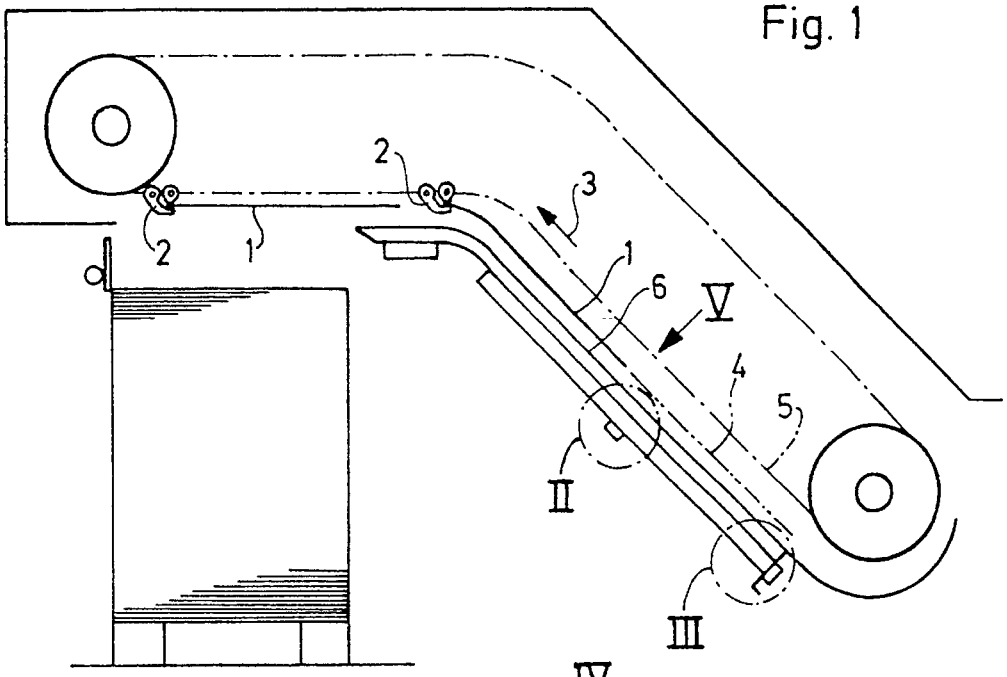
FIG. 1 is a diagrammatic side elevational view of a sheet-guiding device according to the invention integrated into a delivery of a sheet-fed rotary printing press.

Referring now to the drawings and, first, particularly to FIG. 1 thereof, there is shown therein a guiding device for a sheet according to the invention in a delivery of a sheet-fed rotary printing press, wherein a leading edge of a respective sheet 1 is conducted by means of a respective gripper system 2 in a sheet-transport direction represented by the arrow 3 perpendicular to the leading edge, with the result that the leading edge of the sheet 1 follows an imaginary conducting surface 4. In FIG. 1, the conducting surface 4 is represented in phantom by a double dot-dash line and, in the illustrated embodiment of FIG. 1, extends for the most part equidistantly from a side of an endless chain 5 carrying the gripper systems 2. A sheet-guiding surface 6 is spaced uniformly from the conducting surface 4. A respective sheet 1 is exposed to an air flow between a surface of the sheet 1 and the sheet-guiding surface 6. The air flow is generated by a plurality of air jets escaping from a respective flow channel 7 (note FIG. 4), the flow duct 7 being disposed at an angle to the sheet-guiding surface 6 and merging with or terminating in the sheet-guiding surface 6. The flow channel 7 will be discussed in greater detail hereinafter. A plurality of perforations 9 are formed in an integral guide plate 8, as shown most clearly in FIG. 4. Further provided are a plurality of blast-air nozzles 10, 10' with blast-air nozzle end faces 11, the specific number thereof corresponding to the number of perforations 9. The nozzle bodies of the blast-air nozzles 10, 10' are advantageously formed of turned parts or lost-wax castings. In the specific embodiment shown in FIG. 4, the blast-air nozzle 10 is formed with a first flat end-face region 11' a shoulder 12 offset with respect to the first end-face region 11' as well as a baffle plate 13 with a baffle-plate surface, the baffle plate 13 being inserted into the shoulder 12 and being attached in the shoulder 12, for example, by bonding, and the baffle-plate surface representing a second flat end-face region 11" of the blast-air nozzle 10. The thickness of the baffle plate 13 corresponds to the depth of the shoulder 12, so that the first end-face region 11' and the second end-face region 11" lie in one and the same plane. A respective thus-formed blast-air nozzle 10 is fitted into a respective perforation 9 of the guide plate 8 in such a manner that a respective blast-air nozzle end face 11 is flush with the surface of the guide plate 8. The contours of the aforementioned blast-air nozzle end face 11, on the one hand, and of the perforations 9, on the other hand, are matched with one another in such a manner that only a minimal gap required for a problem-free insertion of the blast-air nozzles 10 into the guide plate 8 remains between the contours. After the perforations 9 have been filled in form-locking manner by the blast-air nozzles 10, therefore, the overall sheet-guiding surface 6 is constituted by the guide plate 8, on the one hand, and by the blast-air-nozzle end faces 11, on the other. In this regard, it is noted that a form-locking connection is one which connects two elements together due to the shape of the elements themselves, as opposed to a force-locking connection, which locks the elements together by force external to the elements. Such a size ratio exists between the surface of the guide plate 8, on the one hand, and the entirety of the blast-air nozzle end faces 11, on the other hand, that the surface of the guide plate 8 forms the essential part of the sheet-guiding surface 6.

Within the scope of the invention, the aforedescribed flow channel 7 is formed on the blast-air nozzle 10, 10'. In the illustrated embodiment of the invention, the flow channel 7 is represented by a recess incised into the first end-face region 11', the recess increasing in depth and decreasing in width towards the axis of symmetry of the rotationally symmetrical nozzle body of the blast-air nozzle 10, the wedge-shaped form of the recess, which corresponds to the decreasing width, promoting a fanning-out of an air jet escaping from the flow channel 7 across the surface of the guide plate 8.

The blast-air nozzle 10, 10' is further formed with a nozzle bore 14, 14' passing through the blast-air nozzle 10, 10' and communicating with the flow channel 7. By means of the baffle plate 13, a main flow direction parallel to the sheet-guiding surface 6 is forced on the blast air as it flows through the nozzle bore 14, 14' towards the flow channel 7. To this end, the baffle plate 13 covers the end of the nozzle bore 14, 14' communicating with the flow channel 7 as well as a region of the flow channel 7 close to the nozzle bore 14, 14'.

In a non-illustrated embodiment of a flow channel formed on the blast-air nozzle 10, 10' it is possible to dispense with the provision of the shoulder 12 and with the insertion of the baffle plate 13 into the shoulder 12 and, instead, to provide the flow channel in the form of one or more bores in place of the aforementioned wedge-shaped recess. The bores would, in this case, starting from the blast-air nozzle end face 11 now formed exclusively by the aforementioned first end-face region 11' extend towards the axis of symmetry of the blast-air nozzle 10, 10' inclined to the nozzle bore 14, 14' which, in this case, would be formed as a blind hole at the end thereof facing towards the end face 11.

With regard to the formation of as undisturbed an air flow as possible between the sheet 1 and the sheet-guiding surface 6, the portions of the sheet-guiding surface 6 formed by the guide plate 8 and by the blast-air nozzle end faces 11 are highly polished to the same surface quality.

The guide plate 8 is part of a first assembly. In the construction according to FIG. 5, the first assembly comprises a frame 17 (note FIG. 2) welded together out of frame legs 15 and profile bars 16, of which FIG. 5 shows merely a front lateral section, as viewed in the sheet transport direction. The complete frame 17 comprises two oppositely disposed frame legs 15 and a plurality of profile bars 16, which are arranged like rungs between the frame legs 15. As can be seen best from FIG. 2, the guide plate 8 is laid on the frame 17 and is bolted to the profile bars 16 of the frame 17 through the intermediary of threaded pins 18 placed on the guide plate 8.

Further provided is a second assembly comprising a tube system 19 which conducts blast air and which, in the illustrated embodiment according to FIG. 5, is constituted by variously formed tube arrangements 19.1 to 19.4. Some of the tube arrangements 19.1 to 19.4 are structurally interconnected by means of cross-members 20 with, in the construction shown in FIG. 2 or in FIG. 3, bolted connections 21 being provided between respective tube arrangements 19.1 to 19.4, on the one hand, and respective cross-members 20, on the other hand.

The second assembly comprising the tube system 19, and the first assembly comprising the guide plate 8 are interconnected in a distortion-free manner. In the illustrated embodiment shown, this is realized in the following manner according to FIG. 7. Threaded bolts 22 are inserted into respective end faces of the cross-members 20. The first assembly comprising the guide plate 8 is placed on the second assembly comprising the cross-members 20 in such a manner that a respective end of a cross-member is positioned opposite a respective frame leg 15, and a respective threaded bolt 22 penetrates a respective oblong hole or slot 23 which is formed in a respective frame leg 15. Positioned on a side of the respective frame leg 15 facing the end face of a respective cross-member 20 is a nut 24 which is screwed onto the threaded bolt 22 and is locked by means of a further nut 24 on the other side of the frame leg 15. In this manner, when the first assembly is connected to the second assembly, deformation-causing forces exerted by connecting elements on the first assembly in particular, are prevented, with the result that there is a distortion-free connection between both assemblies. The hereinaforedescribed construction of the first assembly clearly already prevents deformations of the guide plate 8, when it is being installed in the first assembly. The unit composed of the first and the second assemblies thus ensures the desired dimensional stability of the guide plate 8 when it is integrated into the guiding device.

In addition, the first and second assemblies are mutually connected through the intermediary of the blast-air nozzles 10, 10', resulting, however, not in a load-bearing but a functional connection, so that the nozzle bores 14, 14' of the blast-air nozzles 10, 10' fitted into the perforations 9 of the guide plate 8 with the blast-air nozzle end faces 11 flush with the sheet-guiding surface 6 are directly connected to the blast air conducted in the tube system 19. With regard to the prevention of undesired deformations of the guide plate 8, to this end the blast-air nozzles 10, 10' are fixed merely on one of the two aforementioned assemblies. Corresponding constructions are shown in the exemplary embodiment represented in FIGS. 2 to 4.

Figure 2:
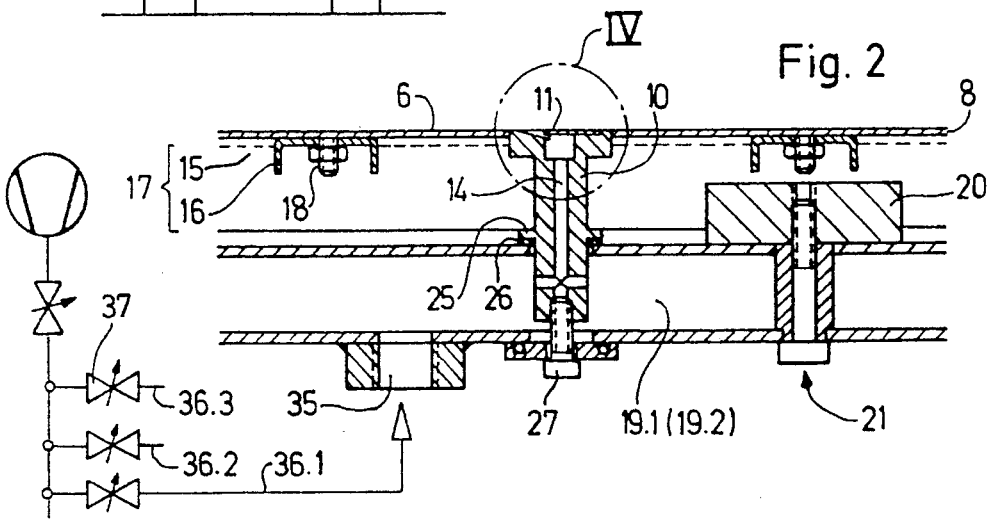
FIG. 2 is an enlarged fragmentary sectional view, partly schematic, of FIG. 1, showing a detail thereof located within the circle II drawn in phantom.
Figure 4:
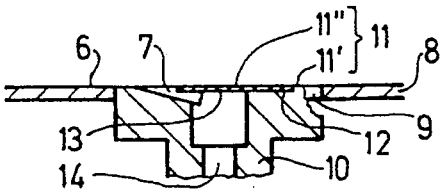
FIG. 4 is an enlarged fragmentary of FIG. 2, showing a detail thereof located within the circle IV drawn in phantom.

In the constructions shown in FIGS. 2 and 4, the blast-air nozzle 10 is inserted, without mechanical connection to the guide plate 8, into a corresponding perforation 9 formed therein. The direct connection of the nozzle bore 14 to the blast air conducted in the tube system 19 is established in that a nozzle stem of the blast-air nozzle 10 comprising the nozzle bore 14 is introduced into the tube arrangement 19.1 and 19.2, respectively, through an opening, situated opposite the perforation 9, in an upper wall (FIG. 2) of the tube arrangement 19.1 and 19.2, respectively, one end of the nozzle bore 14 merging into the interior of the tube arrangement 19.1 and 19.2, respectively. The blast-air nozzle 10 is fixed to the second assembly comprising the tube arrangement 19.1 and 19.2, respectively. For this purpose, the nozzle stem of the blast-air nozzle 10 is provided with a collar 25 which is supported, through the intermediary of a shim-ring arrangement 26, on an outside of the aforementioned upper wall, with the collar 25 being pressed, through the intermediary of the shim-ring arrangement 26, against the aforementioned upper wall by means of a bolt 27 which is introduced into the tube arrangement 19.1 and 19.2, respectively, through a further opening provided in a lower wall thereof and is screwed into the nozzle stem of the blast-air nozzle 10. Possible tilting as a result of positional tolerances of the nozzle stem relative to the openings in the tube arrangement 19.1 and 19.2, respectively, is prevented by appropriate dimensioning of the respective openings and, with the blast-air nozzle end face 11 in the position flush with the sheet-guiding surface 6, the adjustment of the blast-air nozzle 10 is accomplished by means of the shim-ring arrangement 26.

Figure 3:
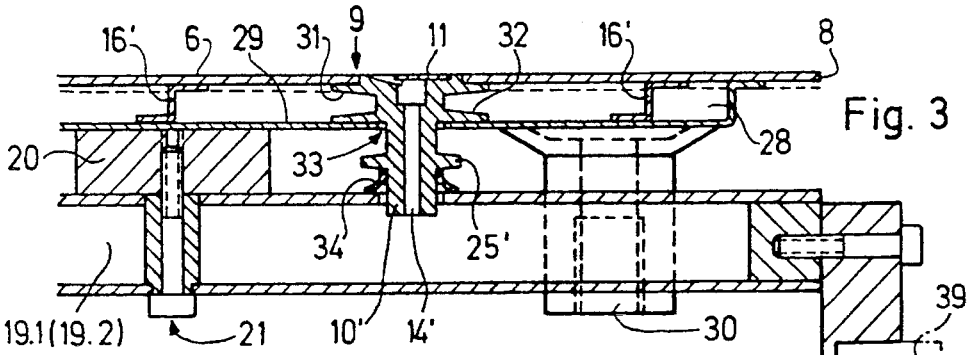
FIG. 3 is an enlarged fragmentary sectional view of FIG. 1, showing a detail thereof located within the circle III drawn in phantom.

FIG. 3 shows a further variant of the fixing of the blast-air nozzle 10' to one of the aforementioned assemblies, in accordance with the invention, with, in this case, the first assembly comprising the guide plate 8 being modified through the incorporation of a cooling device for cooling the sheet-guiding surface 6.

The modified first assembly, in this regard, comprises, in particular, a coolant trough 28, through which there flows a coolant, the coolant trough 28 being formed with a trough floor 29; a lid constituted by the guide plate 8; coolant ports 30, only one of which is illustrated in FIG. 3, for the supply and discharge of the coolant; and profile bars 16' connected at one end to the trough floor 29 and, at the other end, to the guide plate 8, in particular by bonding with adhesive or the like, the profile bars 16' being so dimensioned and arranged that they force a meandering coolant flow through the coolant trough 28.

The mechanical connection of the modified first assembly to the second assembly comprising the tube system 19 is achieved in an equally advantageous manner as in the example described hereinbefore with reference to FIG. 7. Furthermore, there is a functional connection of the modified first assembly to the second assembly likewise in that the nozzle bores 14' of the blast-air nozzles 10' are directly connected to the blast air conducted in the tube system 19, the blast-air nozzles 10', however, being fixed to the modified first assembly in the following manner. A respective blast-air nozzle 10' is provided with a first flange 31 which is recessed from the blast-air-nozzle end face 11 precisely by the plate thickness of the guide plate 8 and is in contact with the underside of the guide plate 8 and connected to the guide plate 8 in this case preferably by adhesive bonding. A second flange 32 of the blast-air nozzle 10' is connected, preferably likewise by bonding, to the inside of the trough floor 29. A part of the nozzle stem of the blast-air nozzle 10', the part thereof adjoining the second flange 32, penetrates a cut-out or recess 33 formed in the trough floor 29 opposite the perforation 9 formed in the guide plate 8 and further penetrates an opening in the upper wall (FIG. 3) of the tube arrangement 19.1 and 19.2, respectively, with the result that, in turn, an end of the nozzle bore 14' merges with or terminates in the interior of the tube arrangement 19.1 and 19.2, respectively.

Whereas the two flanges 31 and 32 of the blast-air nozzle 10' establish the fixing thereof to the modified first assembly, there is no mechanical connection in the sense of a fixing between the blast-air nozzle 10' and the second assembly. Rather, the opening in the upper wall of the tube arrangement 19.1 and 19.2, respectively, is amply overdimensioned with respect to the nozzle stem of the blast-air nozzle 10' and is sealed with respect to the nozzle stem by means of a specially shaped elastic sealing ring 34. The specially shaped sealing ring 34 is clamped between a collar 25' on the aforementioned nozzle stem, on one side, and the outside of the aforementioned upper wall, on the other side.

In this variant of the fixing of the blast-air nozzle 10', the adjustment thereof is accomplished by the mere fitting thereof into a corresponding perforation 9 formed in the guide plate 8, the first flange 31 being placed into contact with the underside of the guide plate 8. The bonded connections of the two flanges 31 and 32 to the guide plate 8 and the trough floor 29, respectively, also provide, simultaneously with the fixing of the blast-air nozzle 10' the sealing of the respective perforation 9 and the cutout 33, opposite thereto, of the trough floor 29 against the escape of the coolant from the coolant trough 28.

In both of the aforedescribed variants, the blast-air nozzles 10, 10' may otherwise be aligned in such a manner that the air jets escaping from the respective flow channels 7 generate an air flow in the same direction as the sheet-transport direction. Such a measure is beneficial to the desired formation of as constant an air flow as possible for conducting the sheet 1.

In an embodiment of the guiding device according to the invention, which is advantageous in various ways, the blast-air nozzles 10, 10' are distributed over the sheet-guiding surface 6 and are combined into functional groups, with a respective functional group being associated with a blast-air port 35 supplying blast air to the blast-air nozzles 10, 10' of the respective functional group. It is advantageous for the blast-air nozzles 10, 10' to be distributed in a regular manner, such as, for example, in an arrangement according to basic geometrical forms, such as in straight lines. In the exemplary embodiment according to FIG. 5, straight lines, in particular, are provided as the ordering system for the blast-air nozzles 10, 10'. This results, in an especially simple geometry, particularly for the tube arrangements 19.1 and 19.2 provided in the embodiment; more specifically, in the form of individual straight tubes which, with the exception of a respective blast-air port 35 and the hereinaforedescribed openings for the introduction and/or fixing of the nozzle stem of a respective blast-air nozzle 10, 10', are sealed.

Advantageous in a first regard is, for example, the parallel arrangement shown in FIG. 5 of corresponding tubes in the form of the tube arrangements 19.1 and 19.2 and the alignment thereof in the sheet-transport direction. This makes it possible, using simple means, to adapt the lateral extent of the range of action of the air flow to the width of the sheets 1 subjected to the air flow. Suitable simple means for such adaptation are represented schematically in FIG. 2 in the form of blast-air lines 36.1 to 36.3, which lead to respective blast-air ports 35 and are separately opened and closed, respectively, by means of valves 37 which are controllable, if necessary or desirable.

Advantageous in a further regard is, for example, the group-wise combination of the blast-air nozzles 10, 10' shown likewise in FIG. 5, so that functional groups of blast-air nozzles 10, 10' situated one behind the other as viewed in the sheet-transport direction, are formed. This makes it possible, in particular, to provide consideration for the fact that different quantities of air may be required along the sheet-guiding surface in the sheet transport direction in order to form an optimal air flow. For this purpose, in the construction according to FIG. 5, functional groups formed with the tube arrangements 19.1 and 19.2 are followed by functional groups which are formed with the tube arrangements 19.3 and 19.4.

Moreover, FIG. 3 shows a further measure which has a favorable effect upon the dimensional stability of the sheet-guiding surface 6. This measure relates to the installation of a guiding device according to the invention in a printing-press frame. In the embodiment shown, the holding forces occurring are introduced directly into the tube system 19, which is represented in FIG. 3 by the tube arrangement 19.1 and 19.2, respectively. The application of force is effected by means of holding blocks 38 connected directly to the tube arrangements 19.1 and 19.2, respectively, with the profile of the holding blocks 38 being formed for form-locking support on a carrying beam 39 of the printing-press frame.

The foregoing is a description corresponding in substance to German Application P 43 08 276.9, dated Mar. 16, 1994, the International priority of which is being claimed for the instant application, and which is hereby made part of this application. Any material discrepancies between the foregoing specification and the aforementioned corresponding German application are to be resolved in favor of the latter.

We claim:

1. Device for guiding a sheet having a leading edge which follows an imaginary conducting surface along a sheet-transport direction perpendicular to the leading edge, the sheet-guiding device being formed with a sheet-guiding surface spaced from the imaginary conducting surface, and having means for generating a plurality of air jets for applying an air flow to the sheet between a surface of the sheet and the sheet-guiding surface, the generating means being formed of respective flow channels for the air jets disposed at an angle to and merging with the sheet-guiding surface, comprising an integral guide plate having a surface constituting a predominant part of the sheet-guiding surface, said integral guide plate being formed with perforations, the air-jet generating means being formed of blast-air nozzles having blast-air nozzle end faces constituting a remaining part of the sheet-guiding surface complementing the predominant part of the sheet-guiding surface to form the entire sheet-guiding surface, said blast-air nozzles fitting into the respective perforations formed in said guide plate so that said blast-air nozzle end faces are flush with said surface of said guide plate, said blast-air nozzles, respectively, having the respective flow channels formed thereon, and being formed with a nozzle bore passing therethrough and communicating with the respective flow channel; and including a first assembly comprising said guide plate, and a second assembly comprising a blast air-conducting tube system, said first assembly being connected to said second assembly in a distortion-free manner, said nozzle bores, respectively, of said blast-air nozzles communicating directly with blast air conducted in said conducting tube system, said second assembly being disposed opposite the surface of said guide plate constituting the predominant part of the sheet-guiding surface; a respective one of said blast-air nozzles being form-lockingly integrated in said first assembly; said blast-air conducting tube system having respective openings formed therein opposite respective ones of said perforations; each of said blast-air nozzles projecting through a respective one of said openings formed in said blast-air conducting tube system and defining an annular gap between said opening and said blast-air nozzle; and sealing means disposed in and sealing said annular gap.

2. Guiding device according to claim 1, wherein said parts of the sheet-guiding surface formed by the guide plate and by the blast-air nozzle end faces are highly polished to a like surface quality.

3. Guiding device according to claim 1, including a cooling device connected to said guide plate for cooling the sheet-guiding surface.

4. Guiding device according to claim 1, wherein said blast-air nozzles are aligned in a like manner so that the air jets escaping from the respective flow channels generate an air flow in the same direction as the sheet-transport direction.

5. Guiding device according to claim 1, wherein said blast-air nozzles are distributed over the sheet-guiding surface and are combined into functional groups, and including a respective blast-air port having a respective functional group of blast-air nozzles associated therewith for supplying blast air to the blast-air nozzles of the respective functional group.

6. Device for guiding a sheet having a leading edge which follows an imaginary conducting surface along a sheet-transport direction perpendicular to the leading edge, the sheet-guiding device being formed with a sheet-guiding surface spaced from the imaginary conducting surface, and having means for generating a plurality of air jets for applying an air flow to the sheet between a surface of the sheet and the sheet-guiding surface, the generating means being formed of respective flow channels for the air jets disposed at an angle to and merging with the sheet-guiding surface, comprising an integral guide plate having a surface constituting a predominant part of the sheet-guiding surface, said integral guide plate being formed with perforations, the air-jet generating means being formed of blast-air nozzles having blast-air nozzle end faces constituting a remaining part of the sheet-guiding surface complementing the predominant part of the sheet-guiding surface to form the entire sheet-guiding surface, said blast-air nozzles fitting into the respective perforations formed in said guide plate so that said blast-air nozzle end faces are flush with said surface of said guide plate, said blast-air nozzles, respectively, having the respective flow channels formed thereon, and being formed with a nozzle bore passing therethrough and communicating with the respective flow channel, including a cooling device connected to said guide plate for cooling the sheet-guiding surface, said cooling device comprising a coolant trough having a coolant flowing therethrough, said guide plate forming a lid sealing said coolant trough, said coolant trough comprising a trough floor formed with recesses located opposite said perforations formed in said guide plate, a respective perforation of said guide plate and a respective recess of said trough floor located opposite the respective perforation being sealed by a respective blast-air nozzle against escape of said coolant from said coolant trough.

* * * * *

UNITED STATES PATENT AND TRADEMARK OFFICE

CERTIFICATE OF CORRECTION

PATENT NO. : 5,497,987
DATED : March 12, 1996
INVENTOR(S) : Manfred Henn et al.

It is certified that error appears in the above-identified patent and that said Letters Patent is hereby corrected as shown below:

Column 10,
Line 9, delete "surface" and insert -- and a reverse side --
Line 28, delete "surface" and insert -- reverse side of said guide --
Lines 29-30, delete "constituting the predominant part of the sheet - guiding surface --

Signed and Sealed this

Fourteenth Day of May, 2002

*Attest:*

*Attesting Officer*

JAMES E. ROGAN
*Director of the United States Patent and Trademark Office*